United States Patent [19]

Myles

[11] 4,350,091

[45] Sep. 21, 1982

[54] CRANK PRESS WITH HYDRAULIC TRANSMISSION

[75] Inventor: J. Edgar Myles, Bloomfield, Mich.

[73] Assignee: J. E. Myles, Inc., Troy, Mich.

[21] Appl. No.: 112,375

[22] Filed: Jan. 15, 1980

[51] Int. Cl.[3] ..... B30B 1/26; B30B 15/16

[52] U.S. Cl. ..... 100/271; 60/389; 60/442; 60/444; 60/456

[58] Field of Search ..... 100/270, 271, 282; 60/395, 404, 406, 442, 444, 456, 468, 453, 494

[56] References Cited

U.S. PATENT DOCUMENTS

| | | | |
|---|---|---|---|
| 2,280,190 | 4/1942 | Ernst | 60/381 X |
| 2,316,497 | 4/1943 | Woodhouse et al. | 60/453 X |
| 2,366,272 | 1/1945 | Le Tourneau | 100/282 |
| 2,736,499 | 2/1956 | Hazen | 60/456 X |
| 3,680,311 | 8/1972 | Harbonn et al. | 60/404 |
| 3,750,406 | 8/1973 | Verlinde et al. | 60/442 |
| 3,901,031 | 8/1975 | Knapp et al. | 60/395 |
| 3,999,387 | 12/1976 | Knopf | 60/444 |

FOREIGN PATENT DOCUMENTS

| | | | |
|---|---|---|---|
| 1135763 | 8/1962 | Fed. Rep. of Germany | 100/282 |

*Primary Examiner*—Irwin C. Cohen

*Attorney, Agent, or Firm*—Cullen, Sloman, Cantor, Grauer, Scott & Rutherford

[57] ABSTRACT

In a crank press having a pedestal and a rotatable crank shaft journaled thereon and connected to a reciprocal top platen guidably mounted on the pedestal to form work pieces, the improvement which comprises a hydraulic motor mounted on the pedestal having a reversible drive shaft connected to the crank shaft, and a hydraulic transmission connected to the hydraulic motor. The transmission includes a pump assembly connected to a reservoir for delivering the pressure fluid selectively under the control of a servo directional valve in a closed hydraulic loop to the hydraulic motor for selective forward and reverse drive together with a safety control to automatically neutralize the pump assembly and control automatic braking of the hydraulic motor drive shaft.

5 Claims, 4 Drawing Figures

CRANK PRESS WITH HYDRAULIC TRANSMISSION

BACKGROUND OF THE INVENTION

Heretofore, conventional crank presses utilized a fly wheel and a bull or pinion gear arrangement for driving the fly wheel and with a mechanically controlled clutch for the control of the conventional crank shaft regulating the reciprocal movements of a top platen normally guidably mounted upon a pedestal for the purpose of forming work pieces with respect to a stationary platen.

Illustrative of the prior art type of mechanically operated and controlled crank press are the following U.S. Pat. Nos.:

148,626 issued Mar. 17, 1874;
340,515 issued Apr. 20, 1886;
653,955 issued July 17, 1900;
661,794 issued Nov. 13, 1900;
1,175,663 issued Mar. 14, 1916;
1,773,438 issued Aug. 19, 1930;
1,834,111 issued Dec. 1, 1931;
1,936,410 issued Nov. 21, 1933;
2,188,146 issued Jan. 23, 1940;
2,249,149 issued July 15, 1941.

Some of the objections to the prior art type of mechanically operated and controlled crank press were that it incorporated no tonnage overload mechanism, had no way of providing a bi-directional low speed jog and did not have variable speed control between 3 rpm and 60 rpm.

The prior art crank presses did not have a fail-safe hydraulically operated brake and had no hydraulic unlock failure and omitted tonnage adjustment control features. These devices operated at a high noise level.

SUMMARY OF THE INVENTION

It is a feature of the present invention to provide an improved crank press which is converted to a totally hydraulically driven press which excludes certain mechanism, namely, the bull or pinion gear and the fly wheel, and at the same time performs the same basic transmission functions, heretofore performed by mechanical devices.

An important feature of the present improved crank press having a hydrostatic transmission which includes a servo valve controlled hydraulic pump assembly driven by an electric motor together with a hydraulic motor having an output shaft directly connected to the crank shaft of the press.

There is incorporated into the hydraulic pump assembly, a servo valve regulated by a primary control electronic driver and which has been preprogrammed to control the output flow of the pump assembly, the mode of the pump assembly which would be either jog, forward or reverse or dynamically stop.

Another important feature of the present invention is directed to secondary controls, i.e., a system wherein electronics are employed to program the hydraulics of the hydraulic transmission and including an electronic control to override the hydraulic pressure of the system. Thus, in the utilization of a 30 ton press, for example, which requires a particular job at 10 ton, the hydraulic system provides a protection so that in the event an object were placed within the motion of the movable platen, the press would stall out rather than continue to go through its cycle as it nomally would in the mode of a mechanical transmission in the prior art.

A further feature of the present invention, therefore, includes safety devices incorporated into the hydraulic controls automatically applied braking to the output shaft of the hydraulic motor should there be a failure of the power drive for the pump assembly or should predetermine overload conditions exist within the closed hydraulic circuit of the hydraulic pump.

A further feature of the present improved hydraulic transmission utilizes, as an example, a 15 horse power motor operating at 1,200 rpm for driving the pump assembly. The hydraulic system will normally operate under 1,700 psi at 30 rpm so that the hydraulic motor will develop enough torque to produce a 15 ton force.

The hydraulic transmission provides a control for adjusting speed from 3 to 40 rpm to a maximum of 60 rpm.

A disc or drum brake assembly is incorporated as a part of the fluid motor for driving the press crank shaft and wherein the brake will be operable when the system is dynamically braked and the transmission pump is in a neutral position and wherein the brake is designed to engage under emergency conditions and in case of a power failure.

These and other features will be seen from the following specification and claims in conjunction with the appended drawings.

THE DRAWINGS

It will be understood that the above drawings illustrate merely a preferred embodiment of the invention and that other embodiments are contemplated within the scope of the claims hereafter set forth.

DETAILED DESCRIPTION OF ONE EMBODIMENT OF THE INVENTION

Figure 1:
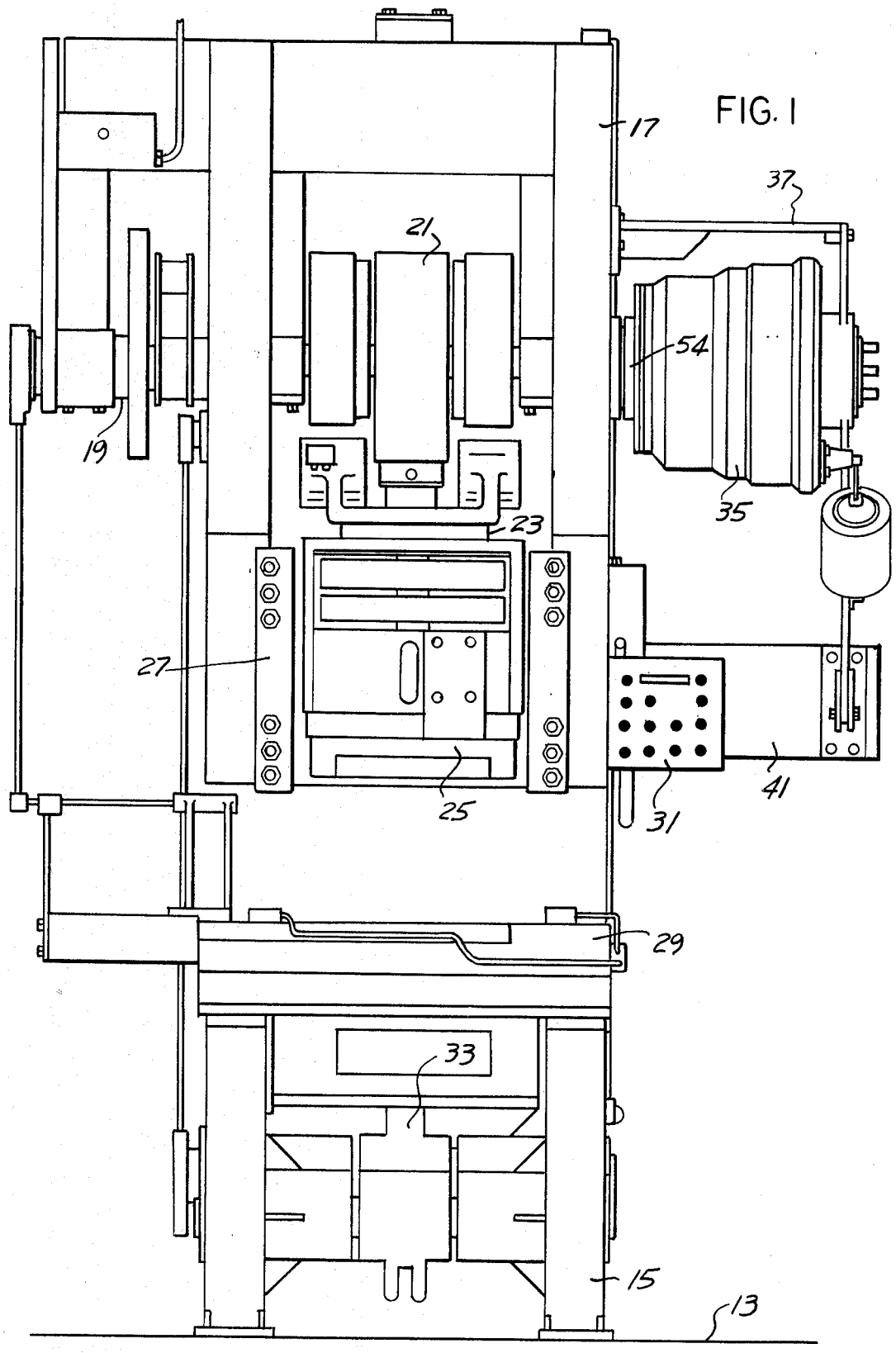
FIG. 1 is a front elevational view of the present crank press with hydraulic transmission.
Figure 2:
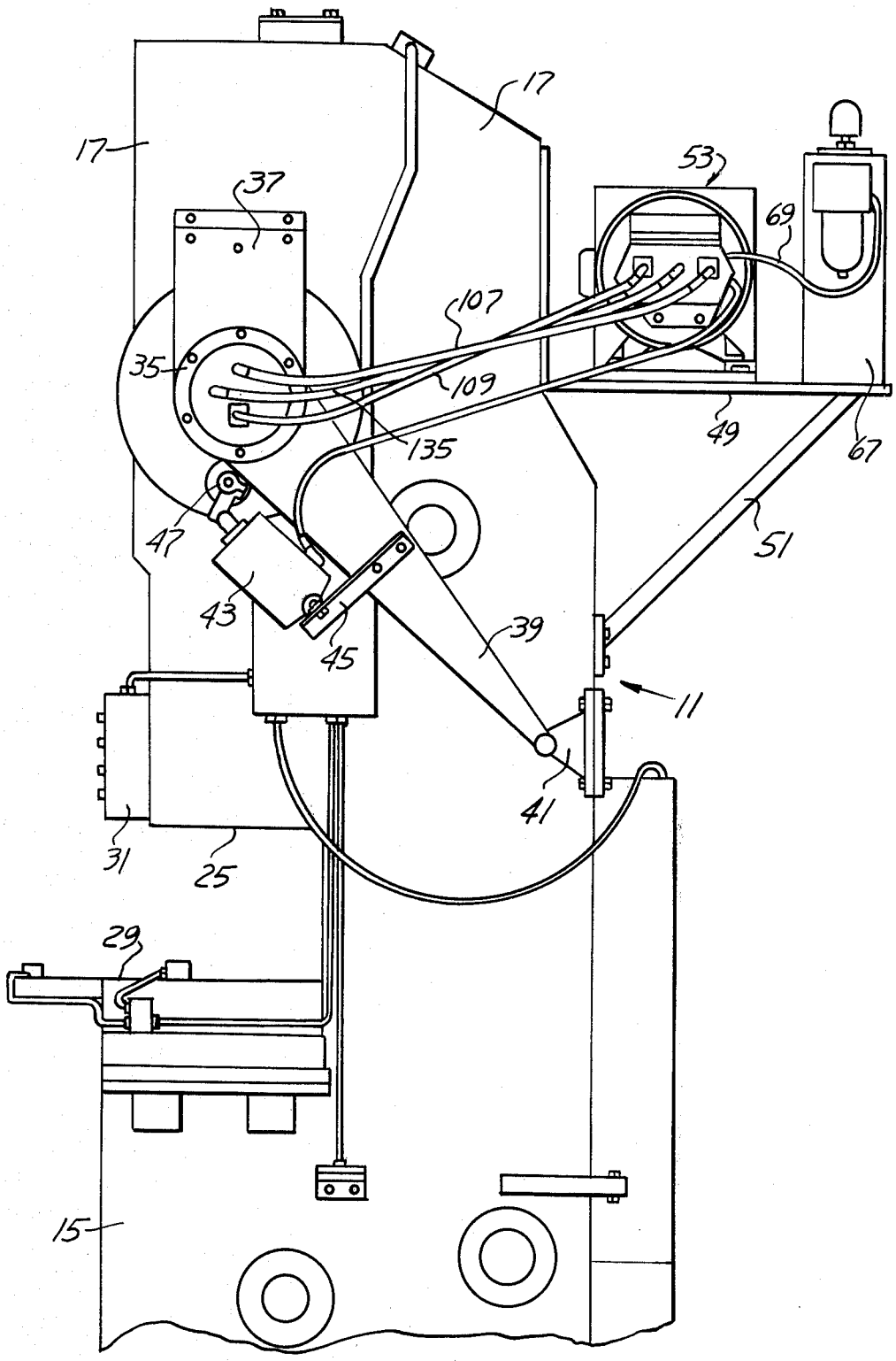
FIG. 2 is a side elevational view thereof.

Referring to the drawing and particularly FIGS. 1 and 2, there is schematically shown, a form of crank press of 30 ton capacity, for example, generally shown at 11 and mounted upon a floor 13 and including a conventional base 15. Overlying the base and connected thereto is a conventional pedestal 17 through which is transversely journaled on suitable bearings and in a conventional manner a rotatable crank shaft 19. The crank shaft 19 includes a crank 21 connected to the reciprocal plunger 23 in turn connected to a top platen 25 guidably mounted upon the pedestal with respect to the guides 27 thereon and with respect to a stationary bottom platen 29. Schematically shown are electrical controls 31 and a conventional form of work piece knockout assembly 33 for the formation of work pieces within the press, applying suitable dies, not shown. Such a press may employ powdered metal and the formation of sintered work pieces therefrom.

A reversible hydraulic motor is generally indicated at 35 and is mounted by bracket 37 upon pedestal 17. Torque arm 39, FIG. 2, is mounted at one end upon bracket 41 projecting from the pedestal and at its opposite end is connected to the hydraulic motor 35.

The hydraulic drum brake includes single acting cylinder 43 anchored at one end upon bracket 45 connected to torque arm 39. The hydraulic drum brake assembly includes a linkage 47 which is directly connected to a braking device upon the hydraulic motor such as a drum 150, FIG. 4, upon its drive shaft, or a disc brake assembly.

Platform 49 is mounted upon the pedestal 17 and secured thereon by the bracket 51, FIG. 2, for supporting the hydrostatic transmission 53. The hydraulic motor 35 includes a reversible drive shaft 54, which is axially aligned with and secured to crank shaft 19 for rotation in unison, as in FIG. 1.

Figure 3:
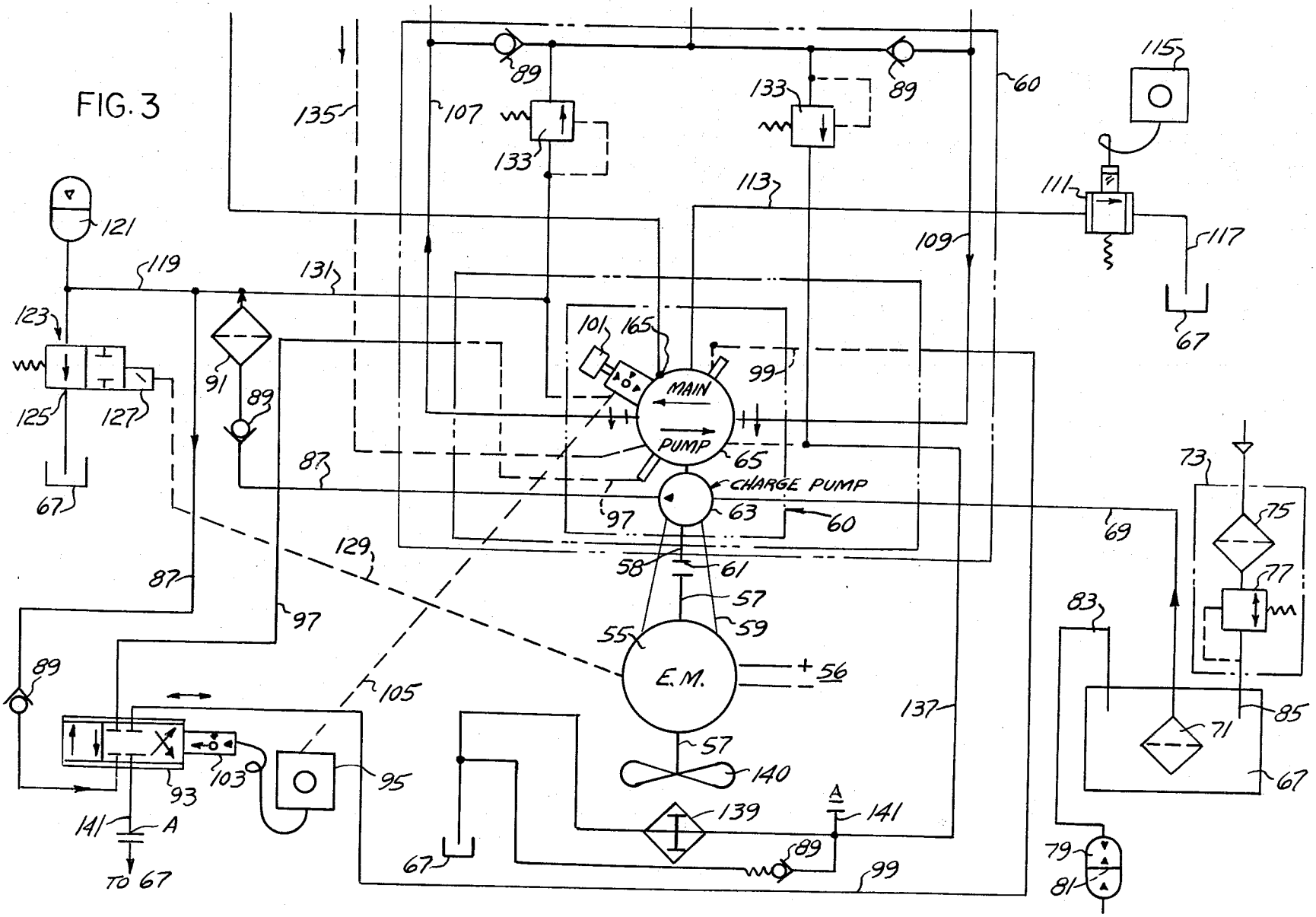
FIG. 3 is a schematic diagram of one portion of the hydraulic transmission.

Referring to the diagram FIG. 3, electric motor schematically shown at 55 is connected to a suitable power source 56, and in the illustrated embodiment, is rated at 15 horse power, 1,200 rpm.

A pump mounting bracket 59 is connected to the motor for mounting the pump assembly 60 and employing a conventional coupling 61 between the motor output shaft 57 and the drive shaft 58 of the pump assembly.

The pump assembly generally indicated at 60, includes charge pump 63 and the variable delivery pressure compensation main pump 65 with a common drive shaft 58.

The closed reservoir 67, FIGS. 2 and 3, in the illustrative embodiment has a 10 gallon capacity. The suction line 69 from the charge pump 63 extends into the fluid, such as oil within said reservoir, and has a screen type filter 71 to prevent the circulation of particles or other impurities through the pump system.

Figure 4:
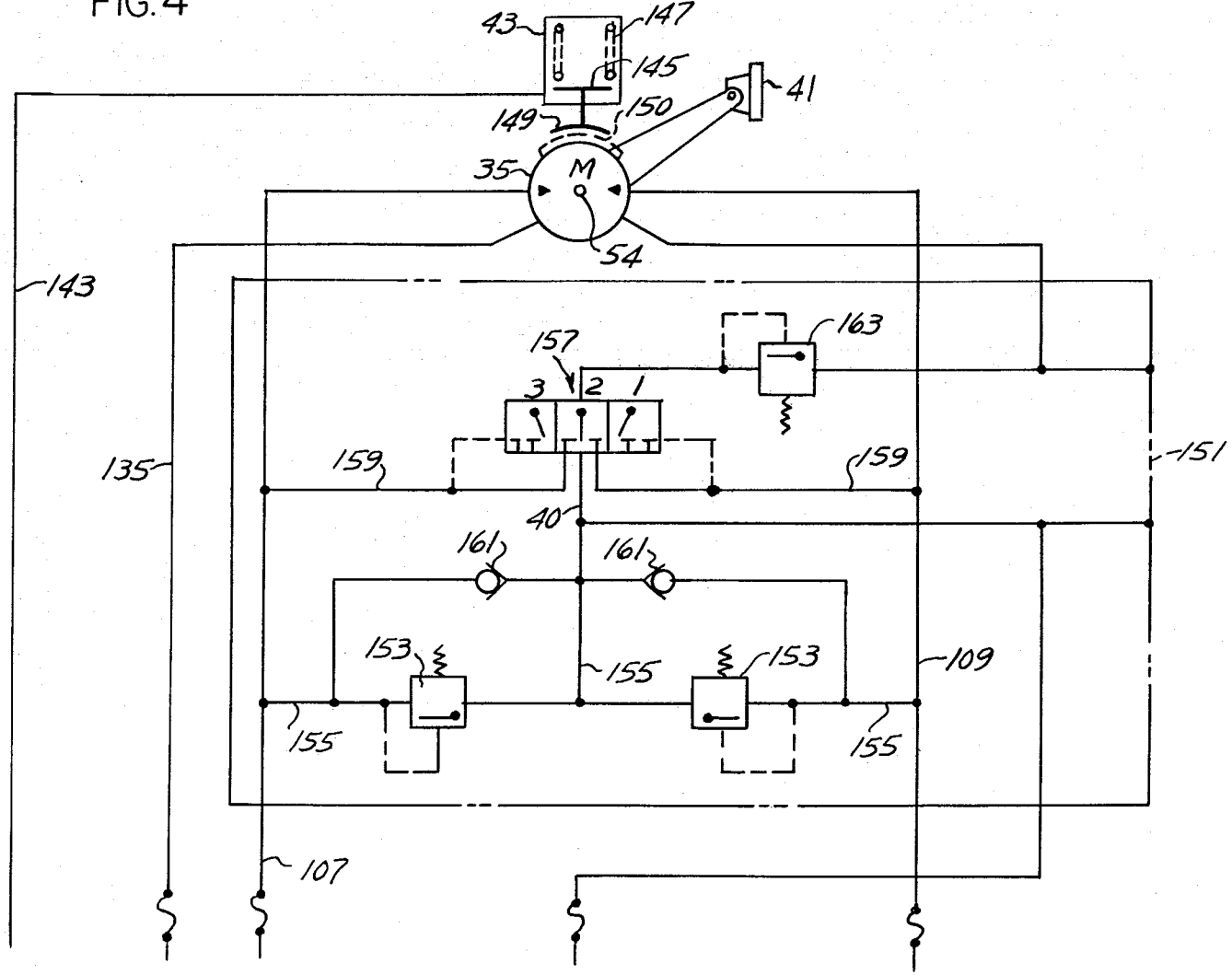
FIG. 4 is a further schematic view of the remaining portion of the hydraulic transmission and including the hydraulic motor and brake assembly.

The reservoir 67 has connected therewith a pressure vacuum filter valve assembly 73 which includes a filter 75 and a preset value 77. The pressure vacuum filter valve assembly is designed to protect the reservoir 67 against over pressurization. At the same time it provides for the filtration of any atmospheric air entering thereinto should there develop a low pressure condition due to an excessive amount of oil installed within the system or possibly a line breaking which could conceivably cause a positive or negative pressurization of the reservoir. Since the reservoir is not a pressure vessel, it is necessary to provide this protection in order to prevent possible fracture of the reservoir. The reservoir 67, also schematically shown at 67 in various portions of the diagrams, FIGS. 3 and 4, is a unit reservoir for the return of hydraulic fluid in the functioning of the hydraulic transmission mechanism.

A "KLEENVENT" (trademark of Greer Hydraulics, Inc.) breather assembly 79 includes a flexible diaphragm 81 of rubber or the like, connected by conduit 83 to the interior of the reservoir 67. This is merely a lung which allows the reservoir to breathe as the oil level therein changes. Since this is a closed system, oil level change is minimal.

Output delivery line 87 from the charge pump 63 includes oil check valve 89 and filter 91 through which pressure fluid from the charge pump 63 is delivered to the servo directional valve 93, FIG. 3. Electronic valve driver 95 is connected to the servo directional valve 93 providing a primary control therefor.

The electronic driver 95 is preprogrammed in order to provide various electrical signals to control the servo directional valve 93 to control the output flow of pressure fluid to the conduits 97 and 99, selectively, which are connected to the main pump 65 in a closed hydraulic loop. The main pump 65 is a cross-over center variable displacement pump.

The servo directional valve 93 therefore functions in determining the pressure fluid output through either of the conduits 97 or 99 to the main pump 65 for determining the position thereof, from a conventional neutral central position to one of a pair of other positions for directing pressure fluid through the closed loop conduits 107 and 109, selectively, for forward or reverse direction of operation of the hydraulic motor 35 and its drive shaft 54.

The preprogramming of the electronic driver 95 for the servo directional valve 93 not only controls the amount of flow of pressure fluid to determine direction of rotation of the hydraulic motor drive shaft 54 as well as relevant speed of rotation in either forward or reverse direction or for placing the main pump in a central neutral position where there is no flow of pressure fluid to the hydraulic motor. In such a neutral position, the pressure fluid is drained back to the reservoir as through conduit 137. The charge or servo pump 63 supplies servo pressure for controlling the displacement of pump 65 and replenishment pressure.

Upon or connected to the drive shaft of the main pump 65, there is a rotary variable differential transducer (RVDT) adapted to provide a feedback signal to the servo valve 93 and to the electronic driver 95 which defines the positioning of the pump and closes the hydraulic loop between the servo valve 93 and the main pump 65. There is schematically shown in FIG. 3 a force motor 103 for the servo valve 93.

A lead 105 connects the rotary variable differential transducer 101 to the electronic driver or position control 95 which is programmed to a particular mode. For example, for a forward continuous mode at a certain number of strokes per minute or gallons per minute, as related to the main pump 65. When this value is set in the driver 95, the pump 65 at the command of the driver 95 will continue to move to the preselected mode. RVDT 101 will then signal back to driver 95 when the pump 65 reaches the preselected mode and thus close the hydraulic loop. This insures that the main pump mode is as preselected and programmed in the electronic driver 95.

The feedback is one of the principal elements of a closed loop servo system. This subtracts from the input signal leaving the error signal to actuate the output element. When the output is at the desired value feedback equals imput, and the error is zero.

The present charge pump 63 is an integral part of the main pump 65 referred to as the pump assembly having a common drive shaft 58 connected to the electric motor drive shaft 57 and is adapted to provide (1) pilot pressure for pressure compensation to the main pump 65 and (2) servo pressure through the servo valve 93 for the purpose of positioning the main hydraulic variable displacement pump 65. The charge pump 63 also provides a filtered flow of hydraulic fluid through the filter 91 to the respective legs 97 and 99 of the primary circuit.

The conduits 107 and 109 interconnect main pump 65, when in one of its control positions, with the hydraulic motor 35, for rotating its drive shaft 54 in a forward or reverse direction, depending on whether the flow of pressure fluid is through conduit 107 or 109.

Between the two positions of adjustment of the main pump 65, there is a neutral position so that if pressure fluid is cut off to the main pump due to the central positioning of the servo valve 93, pressure fluid is drained from the main pump through the drain conduit 137 and heat exchanger 139 back to the reservoir 67.

A primary relief valve 111 is connected by the conduit 113 to the main pump 65 for selecting the maximum operating pressure of the system. Valve 111 has connected thereto an electronic pilot operated control 115. It is contemplated as equivalent construction that the control could be air pilot operated so that excess pressure fluid is returned to the reservoir 67 through the conduit 117, FIG. 3.

Connected to the charge pump delivery conduit 87 is a branch conduit 119 which is connected to an accumulator 121. This provides an auxiliary power source. The accumulator, in a conventional manner, stores the hydraulic pressure fluid delivered by the charge pump 63 and then releases this stored fluid upon demand to complete the cycle, thereby functioning as a secondary source of power and assisting the charge pump. Thus, the accumulator 121 provides for a higher flow rate than would otherwise be provided by the charge pump.

The same conduit 119 to the accumulator 121 is connected to a safety circuit 123 which includes a normally open valve 125 for dumping pressure fluid back to the reservoir 67. Connected to the normally open valve 125 is an electrically operated valve control 127 which is connected by a suitable lead 129 to the electric motor 55. Accordingly, the valve 125, is activated only when the electrical motor is energized to start. Should the motor be de-energized for any reason, including a power failure to the motor, as schematically shown, electronic valve 125 is de-energized so that the normally open valve 125 drains hydraulic fluid back to the reservoir. With a full pressure drop, main pump 65 automatically returns to a neutral mode, and the brake system to the hydraulic motor drive shaft is braked.

Relief valve 133 connected by conduit 131 to the charge pump delivery pipe 87 provides a safety control for the charge system. Accordingly, any excess pressure passes through the relief valve 133 and through the ball check 89 is connected with one of the conduits 107 or 109 for return to the main pump 65 and through drain line 137 back to the reservoir 67.

There is a hot oil drain conduit 135, FIG. 4, which interconnects the hydraulic motor 35 and the main pump 65 for exhausting and return via conduit 137 to the reservoir 67. Heat exchanger or cooler 139 is interposed in the drain conduit 137 and is located adjacent the fan 140 upon the drive shaft 57 of the electric motor 55.

There is shown with respect to the servo directional valve 93, a drain line 141 and the letter A connected therewith. This corresponds to the connection 141 with the letter A connected to the drain conduit 137 back to the reservoir.

The conduits 107 and 109 make up the closed hydraulic loop which controls the hydraulic motor 35. Oil under pressure supplied through these conduits selectively will control the motor and its drive shaft 54 in the forward, reverse and brake modes thereof.

The connection A associated with conduit 141, FIG. 3, simply indicates some of the return lines such as shown for direction back to the reservoir 67.

The pressure conduit 143 referred to as a brake and neutral by-pass connection, connects a brake and neutral by-pass valve, not shown, of the main pump 65, FIG. 3, to the brake assembly, shown in FIG. 4. The brake assembly, shown as single acting hydraulic cylinder 43 includes a reciprocal piston 145, normally biased outwardly of the single acting cylinder by a coil spring 147. The piston and its associated piston rod mounts a brake element 149 which may be in the form of a drum brake for engagement with a corresponding drum 150 upon the drive shaft 54 of the hydraulic motor or any other type of braking means such as a disc brake assembly upon the hydraulic motor drive shaft.

In operation, when the main pump 65 is commanded to go to the central position under the control of the servo control valve 93, dynamic braking takes place of the hydraulic motor 35. When the hydraulic pump 65 is in a central position or a zero output mode, the conduit 143 from the hydraulic actuator 43 is in a drain mode back to the hydraulic reservoir and the spring 147 in the actuator causes the actuator to engage a drum or disc type brake upon the drive shaft of the hydraulic motor to insure mechanical locking of the press crank shaft 19, FIG. 1. When the main pump 65 is commanded to go off center, a hydraulic signal is released from the pump, i.e., pressure fluid, to the brake assembly 43 causing a retraction of the piston 145 and associated piston rod and braking element 149, thus relieving the brake force and allowing the fluid in the motor to rotate in the direction of its command.

Referring to FIG. 4, the manifold assembly is designated at 151 and includes primary relief valves 153, which are normally set higher than the basic relief valve 111. Accordingly, manifold 151 includes all of the valving shown in FIG. 4 providing a secondary control for the hydraulic loop which includes the conduits 107 and 109 to the hydraulic motor.

There is provided a primary relief valve 153 for each leg 107, 109 of the system which are used only as in over-ride condition to the fluid motor 35. Therefore, these valves are normally set higher than the primary relief valve 111. In the event that either of these valves are open, they become heat generators. Fluid going through these valves will be heated at the orifice in the valve. Pressure fluid is carried through one of the valves 153, selectively, up through conduit branch line 155 through the hot oil valve 157 and the relief valve 163 back through the fluid motor 35, through the drain line 135 to pump 65, through the drain 137 back to reservoir 67.

With respect to the right leg of the system, namely, the conduit 109 to the hydraulic motor, assuming that the motor is in an overload condition results in the valve 153 relieving pressure oil from conduit 109 of the system. One of the pilot lines 159 which interconnect the hot oil valve 157 with the respective conduits 107 and 109 will pick up this high pressure signal and cause the hot oil valve 157 to shift from the number 1 position to position number 2. When the valve 157 shifts to position number 2, the conduit 155 is blocked and the flow of pressure oil is through one of the pressure relief valves 153 through adjacent check valve 161 to the other leg 107 of the system, and attempts to make up for any lost oil in the return leg 107. After the oil is made up in said return leg, oil is then diverted back through the hot oil valve 157 inasmuch as the valve is now in a centered position number 1. The path of flow is through the hot oil valve 157 up through the relief valve 163. The relief valve 163 is set at a very low pressure but at a pressure high enough to insure the operation of the adjacent check valves 161.

The oil is then diverted through this valve back through the conduit 135 through the fluid motor 35 and back through the hydraulic pump 65 ultimately through the drain conduit 137 back to the coder 139 and to the reservoir 67.

The same sequence of events take place in the event the motor's overload is in the left hand leg 107 of the system.

The hot oil valve 157 in that instance would then shift from position number 3 to position number 2 and the reverse action would take place.

In the schematic illustrations, FIGS. 3 and 4, the pressure relief valves 133 are respectively set at 325 and 150 psi for illustration. Primary relief valves 153 are set at 300 psi, for example, and the adjacent check valves have been preset at 5 psi. The relief valve 163 has been preset at 200 psi. These settings are for illustration only for one embodiment of the present invention.

Having described my invention, reference should now be had to the following clams.

I claim:

1. In a crank press having a base, pedestal, a rotatable elongated crank shaft having an axis journaled thereon for controlling reciprocal movement of a top platen guidably mounted upon said pedestal for the formation of work pieces supported on a stationary bottom platen; the improvement comprising a rotary hydraulic motor mounted on said pedestal having a reversible drive shaft connected to and longitudinally aligned with said crank shaft for rotation in unison about the same axis; a torque arm connecting said rotary hydraulic motor to said pedestal; a hydrostatic control transmission mounted on said pedestal and connected to said motor; said transmission comprising a fluid reservoir, a hydraulic pump assembly including a main variable delivery compensating pump and a charge pump, said charge pump connected to said reservoir and having an output conduit connected to a servo directional valve, said directional valve being connected to said main pump by a pair of separately operable output conduits for providing a predetermined pilot pressure to displacement servo controls for selectively controlling its operating mode, forward and reverse, an electronic driver connected to said directional valve, said driver being programmed for a particular mode, forward continuous, reverse continuous and jog, at a certain number of strokes per minute or gallons per minute; said main variable delivery compensating pump having a pair of pressure fluid outlets connected to said hydraulic motor for selectively delivering hydraulic fluid under pressure to and from opposite sides of said hydraulic motor in a closed hydraulic loop for selective forward and reverse rotation of said crank shaft; said pump assembly having a neutral mode position and a pair of alternately operable fluid motor drive positions; said hydraulic motor including a drum on its drive shaft; a drum brake including a single acting cylinder secured to said torque arm and having a reciprocal piston and piston rod; a brake element on said piston rod; a coil spring within said cylinder normally biasing said brake element into retaining registry with said drum when the pump assembly is in a neutral mode; and a pressure conduit interconnecting said cylinder an pump assembly adapted for transmitting pressure fluid to said cylinder when said pump assembly is in one of its operating modes, to retract said brake element; said main pump having a drive shaft, a rotary variable differential transducer connected to said drive shaft, and a transmission receiver connected to said servo valve and its electronic driver; and a circuit between said transducer and said receiver providing a feedback signal to said servo valve until said pump reaches the preselected mode for closing the hydraulic loop between said servo valve and main pump; an electric motor connected to a power source and to said charge pump and main pump, and a safety circuit including a normally open electronic valve connected into the charge pump conduit, adapted in one position to drain pressure fluid to said reservoir, to deactivate said hydraulic motor; and an electric connection between said electric motor and electronic valve for maintaining said valve in a closed position while said electric motor is energized; and said hydrostatic transmission including a primary relief valve preset for the maximum operating pressure of the system; a conduit interconnecting the main pump and said relief valve, and an electronic controller connected to said primary relief valve for controlling its pressure setting.

2. In the crank press of claim 1, said hydrostatic transmission including a fluid drain conduit interconnecting said main pump and reservoir;

a heat exchanger in said drain conduit for cooling returning fluid;

and a fan on said drive shaft adjacent and spaced from said heat exchanger.

3. In the crank press of claim 1, a drain conduit interconnecting said hydraulic motor and said main pump;

and a fluid drain conduit interconnecting said main pump and said reservoir, heated oil from said hydraulic motor returning to said reservoir.

4. In the crank press of claim 1, said hydrostatic transmission including a manifold assembly, said manifold assembly including a pair of heat generating primary relief valves for each leg of the hydraulic closed loop connected respectively to the fluid delivery conduits between the main pump and said hydraulic motor;

and a second conduit between said pair of primary relief valves and hydraulic motor for delivering excess pressure fluids through said main pump to said reservoir, said pair of pressure relief valves being set higher than said primary relief valve.

5. In the crank press of claim 4, a hot oil valve connected into said second conduit, said hot oil valve having a neutral position and a pair of alternatively operable control positions;

a pilot line interconnecting each fluid conduit to said hydraulic motor and one of said pressure relief valves, whereby, depending upon which leg or fluid conduit to said hydraulic motor is delivering fluid, the hot oil valve will respond to the excess pressure due to an overload upon said hydraulic motor for directing excess hot oil to the other leg or conduit between the main pump and the hydraulic motor until the pressure balanced between said conduits to said hydraulic motor, said hot oil valve returning to a neutral position draining excess hot oil through said hydraulic motor back to said main pump and then returned to said reservoir.

* * * * *